US008570238B2

(12) United States Patent
Wansch et al.

(10) Patent No.: US 8,570,238 B2
(45) Date of Patent: Oct. 29, 2013

(54) LEAKY-WAVE ANTENNA

(75) Inventors: Rainer Wansch, Baiersdorf (DE); Mario Schuehler, Marloffstein (DE); Matthias Hein, Martinrode (DE)

(73) Assignees: Fraunhofer-Gesellschaft zur Foerderung der Angewandten Forschung e.V., Munich (DE); Technische Universitaet Ilmenau, Ilmenau (DE)

( * ) Notice: Subject to any disclaimer, the term of this patent is extended or adjusted under 35 U.S.C. 154(b) by 413 days.

(21) Appl. No.: 13/074,101

(22) Filed: Mar. 29, 2011

(65) Prior Publication Data

US 2011/0241972 A1 Oct. 6, 2011

(30) Foreign Application Priority Data

Mar. 30, 2010 (DE) ..... 10 2010 003 457

(51) Int. Cl.
*H01Q 11/12* (2006.01)

(52) U.S. Cl.
USPC ..... 343/893; 343/700 MS

(58) Field of Classification Search
USPC ..... 343/893, 700 MS
See application file for complete search history.

(56) References Cited

U.S. PATENT DOCUMENTS

| | | | | |
|---|---|---|---|---|
| 6,545,647 | B1 | 4/2003 | Sievenpiper et al. | |
| 8,436,785 | B1 * | 5/2013 | Lai et al. | 343/909 |
| 2006/0187126 | A1 * | 8/2006 | Sievenpiper | 343/700 MS |
| 2010/0311364 | A1 * | 12/2010 | Rofougaran et al. | 455/127.1 |

FOREIGN PATENT DOCUMENTS

| | | | |
|---|---|---|---|
| EP | 1 753 085 | A1 | 2/2007 |

OTHER PUBLICATIONS

Schühler et al., "Experimental Study of the Radiation Characteristics of a Finite Periodic Structure Excited by a Dipole", 3rd European Conference on Antennas and Propagation, 2009, EUCAP 2009, IEEE, Piscataway, NJ, USA, Mar. 23, 2009, pp. 3055-3059.

Ip et al., "An Improved Calculation Procedure for the Radiation Pattern of a Cylindrical Leaky-Wave Antenna of Finite Size", IEEE Transactions on Antennas and Propagation, IEEE Service Center, Piscataway, NJ, US, vol. 40, No. 1, Jan. 1, 1992, pp. 19-24.

Schühler et al., "Analysis and Design of a Planar Leaky-Wave Antenna for Mobile Satellite Communications based on a Strongly Truncated Periodic Structure", Antennas and Propagation Society International Symposium (APSURSI), 2010 IEEE, Piscataway, NJ, USA, Jul. 11, 2010, pp. 1-4.

(Continued)

*Primary Examiner* — Allyson Trail
(74) *Attorney, Agent, or Firm* — Keating & Bennett, LLP

(57) ABSTRACT

A leaky-wave antenna includes a sheet arrangement having first, second and third metalized sheets that are arranged on top of and in parallel with one another and are separated by two di-electric layers, the first metalized sheet having a first two-dimensionally periodic metalization structure, the second metalized sheet having a second two-dimensionally periodic metalization structure, and the third metalized sheet having a continuous metalization area, and an excitation structure above the first metalized sheet for exciting a leaky-wave mode in the sheet arrangement at a working frequency $f_0$ of the leaky-wave antenna, wherein the sheet arrangement exhibits a shape of a regular n-gon with $N \geq 8$ ($N \in Z$) or a circular shape as the edge boundary.

13 Claims, 9 Drawing Sheets

(56) References Cited

OTHER PUBLICATIONS

Schühler et al., "Impedance Measurement of a Dipole Above a Periodically Structured Reflective Surface", IEEE Antennas and Wireless Propagation Letters, Piscataway, NJ, US, vol. 7, Jan. 1, 2008, pp. 617-620.

Caloz et al., "Planar Distributed Structures With Negative Refractive Index", IEEE Transactions on Microwave Theory and Techniques, Piscataway, NJ, USA, vol. 52, No. 4, Apr. 1, 2004, pp. 1252-1263.

Official Communication issued in corresponding European Patent Application No. 11159856.1, mailed on Jun. 1, 2011.

Popugaev et al., "Low Profile Automotive Antennas for Digital Broadcasting", 9th Workshop Digital Broadcasting, Sep. 18-19, 2008, 8 pages.

Sievenpiper, "Forward and Backward Leaky Wave Radiation With Large Effective Aperture From an Electronically Tunable Textured Surface", IEEE Transactions on Antennas and Propagation, vol. 53, No. 1, Jan. 2005, pp. 236-247.

Goldstone et al., "Leaky-Wave Antennas I: Rectangular Waveguides", IRE Transactions on Antennas and Propagation, vol. 7. No. 4, Oct. 1959, pp. 307-319.

Schuehler et al., "Experimental Study of the Radiation Characteristics of a Finite Periodic Structure Excited by a Dipole", Proc. of EuCAP 2009, Mar. 23-27, 2009, 5 pages.

Sanada et al., "Planar Distributed Structures With Negative Refractive Index", IEEE Transactions on Microwave Theory and Techniques, vol. 52, No. 4, Apr. 2004, pp. 1252-1263.

Official Communication issued in corresponding German Patent Application No. 10 2010 003 457.6, mailed on Mar. 9, 2011.

Oliner et al., "Leaky-Wave Antennas", Antenna Engineering Handbook, 4th Ed., McGraw-Hill, Ch. 11, 2007.

Schuhler et al., "Impedance Measurement of a Dipole Above a Periodically Structured Reflective Surface", IEEE Antennas and Wireless Propagation Letters, vol. 7, 2008, pp. 617-620.

* cited by examiner

LEAKY-WAVE ANTENNA

Embodiments of the present invention relate to leaky-wave antennas in general, and in particular to the architecture of a planar leaky-wave antenna for mobile satellite communication, which is configured, for example, for the frequency range from 2170 to 2200 MHz and which supports transmitting and receiving linearly, cross- and/or circularly polarized electro-magnetic waves and has a conical directivity pattern in the case of circular polarization.

BACKGROUND OF THE INVENTION

For mobile satellite communication, transmit/receive antennas may be used that have a low constructional height, on the one hand, and have a directivity pattern that can guarantee maximum reception quality of the signals irrespective of the position of a mobile subscriber relative to the satellite, on the other hand. For example, if the satellite signal arrives from a direction of fixed elevation, the antenna should guarantee constant reception quality irrespective of the azimuth angle, which is achieved, for example, with a conical directivity pattern for the antenna.

In this context, please refer to the following scientific publications:

[1] A. Popugaev and R. Wansch, "Low profile automotive antennas for digital broadcasting", in 9th Workshop Digital Broadcasting, Erlangen, Sep. 18-19, 2008

[2] D. Sievenpiper, H.-P. Hsu, J. Schaffner, and G. Tangonan, "Antenna system for communicating simultaneously with a satellite and a terrestrial system", U.S. Pat. No. 6,545,647, Apr. 8, 2003.

[3] D. Sievenpiper, "Forward and backward leaky-wave radiation with large effective aperture from an electronically tunable textured surface", IEEE Transactions on Antennas and Propagation, vol. 53, no. 1, pp. 236-247, January 2005.

[4] L. Goldstone and A. Oliner, "Leaky-wave antennas I: Rectangular waveguides", IRE Transactions on Antennas and Propagation, vol. 7, no. 4, pp. 307-319, 1959.

[5] A. A. Oliner and D. R. Jackson, "Leaky-wave antennas", in Antenna Engineering Handbook, 4th ed. McGraw-Hill, 2007, ch. 11.

[6] M. Schühler, R. Wansch, and M. A. Hein, "Experimental study of the radiation characteristics of a finite periodic structure excited by a dipole", in Proc. Of EuCAP'2009, Berlin, Germany, Mar. 23-27 2009, pp. 3055-3059.

Propagation of leaky waves along periodic structures has been a well-known phenomenon for quite some time, just like the attempt at utilizing them for antenna applications. Leaky wave arrangements, or leaky waveguides, are understood to mean waveguides for electromagnetic waves that allow energy to enter and exit not only at the ends, but to a certain degree also across the entire length or surface area of the leaky wave arrangement (of the leaky waveguide).

However, conventional leaky-wave antennas have apertures, i.e. radiation areas whose lateral sizes are large, at least in one dimension, as compared to the wavelength $\lambda_0$ at the working frequency $f_0$. Typical implementations of leaky-wave antennas in accordance with conventional technology thus comprise lateral dimensions in the order of magnitude of, e.g., 20 wavelengths ($20\lambda_0$), wherein at a working frequency $f_0$ of 2.2 GHz, a wavelength $\lambda_0$ corresponds to about 13.6 cm, and, thus, the following is true for the dimensions: $20*\lambda_0=2.73$ cm.

SUMMARY

According to an embodiment, a leaky-wave antenna may have: a sheet arrangement having first, second and third metalized sheets that are arranged on top of and in parallel with one another and are separated from one another by two dielectric layers; the first metalized sheet having a first two-dimensionally periodic metalization structure, the second metalized sheet having a second two-dimensionally periodic metalization structure, and the third metalized sheet having a continuous metalization area; and an excitation structure above the first metalized sheet for exciting a leaky-wave mode in the sheet arrangement at a working frequency $f_0$ of the leaky-wave antenna; wherein the sheet arrangement exhibits a shape of a regular n-gon with $N \geq 8$ ($N \in Z$) or a circular shape as the edge boundary.

In this context, the sheet arrangement has, e.g., an overall diameter, with regard to a distance of two opposite sides of the n-gon or of the circle diameter of the sheet arrangement, of less than 5 times the value of the free-space wavelength $\lambda_0$ of the leaky-wave antenna at the working frequency.

Embodiments of the present invention are based on the finding that the inventive leaky-wave antenna has essentially two degrees of freedom for suitable dimensioning in order to achieve the desired electric characteristics. Thus, the main direction of radiation of the leaky-wave antenna may be determined or specified by specifically setting the wave number of the leaky wave excited in the sheet arrangement. In addition, the beamwidth in the main direction of radiation may be influenced, or set, by setting the size and shape of the overall structure.

In accordance with embodiments of the present invention, the leaky-wave antenna comprises a sheet arrangement having two-dimensionally periodic metalization structures and supporting the propagation of leaky waves in the sheet arrangement; in this context, such arrangements or structures which have a specific (e.g. the same) periodicity in two linearly independent (e.g. orthogonal) directions in one plane are referred to as two-dimensionally periodic. In addition, elements for exciting the leaky wave are provided above the sheet arrangement in the form of an excitation structure.

In particular, the fundamental idea underlying the inventive leaky-wave antenna is based on utilization of the radiation properties of leaky waves, on the one hand, and on the targeted delimitation of the structured surface of the leaky-wave antenna, on the other hand, for setting the radiation characteristic in a targeted manner. In accordance with embodiments of the present invention, a (approximately) non-directional dispersion characteristic of the sheet arrangement may be achieved by the selection of the individual cells of the sheet arrangement as will be presented below. In addition, the wave number of the leaky wave may be specified by the implementation of the sheet arrangement, the wave number of the leaky wave being defined by the main direction of radiation of the leaky-wave antenna and by the beamwidth, which in turn is related to the size of the overall structure of the leaky-wave antenna. The two-dimensional periodicity of the metalization structures of the sheet arrangement further enables radially symmetrical propagation of the leaky wave within the sheet arrangement, said radially symmetrical propagation being a precondition for a conical directivity pattern of the leaky-wave antenna.

In accordance with embodiments of the present invention, the shape of a regular n-gon, such as an octagon, decagon (regular decagon), or a dodecagon (regular dodecagon), is used for the floor space, or surface area, of the leaky-wave antenna, or its sheet arrangement, so as to enable azimuth-independent propagation of the leaky wave upon excitation by the excitation structure within the sheet arrangement and, thus, a conical directional effect of the leaky-wave antenna.

As an alternative to regular n-gons, an approximately circular floor space of the leaky-wave antenna up to a perfectly circular floor space may be used.

Excitation of the antenna structure, i.e. excitation of the desired leaky-wave mode within the sheet arrangement, is effected via an excitation structure realized, for example, by two dipoles arranged in a cross shape (cross-dipole arrangement) mounted centrally above the sheet arrangement. With regard to excitation of the respective leaky-wave mode in the sheet arrangement it is to be noted that the excitation may possibly influence the directivity pattern of the leaky-wave antenna. With circularly polarized excitation, for example, the inventive planar leaky-wave antenna has a conical directivity pattern. Depending on the feed of the individual dipoles, linearly, cross-, or circularly polarized waves may be excited.

It shall also be noted in this context that in accordance with the present invention, the lateral dimensions of the leaky-wave antenna are an important parameter regarding the resulting characteristics of the leaky-wave antenna and also determine, e.g., the directivity pattern of the leaky-wave antenna in addition to the dispersion behavior of the sheet arrangement. The following detailed description will specifically address how the shape and beamwidth of the directivity pattern may be set in a targeted manner.

On the basis of the inventive architecture of the leaky-wave antenna, the height of the entire arrangement may be designed to be clearly smaller than the wavelength $\lambda_0$ at the working frequency $f_0$ of the leaky-wave antenna, so that the leaky-wave antenna may be considered as being "planar". Since in embodiments, the inventive leaky-wave antenna technically is a multi-sheet printed circuit board, the leaky-wave antenna may be constructed, for example, by using established manufacturing processes. By means of flexible substrate materials and corresponding manufacturing technologies, it is also possible in this context to realize conforming implementations, i.e. implementations that are adapted to curved surfaces.

BRIEF DESCRIPTION OF THE DRAWINGS

Embodiments of the present invention will be detailed subsequently referring to the appended drawings, in which.

DETAILED DESCRIPTION OF THE INVENTION

Figure 1A:
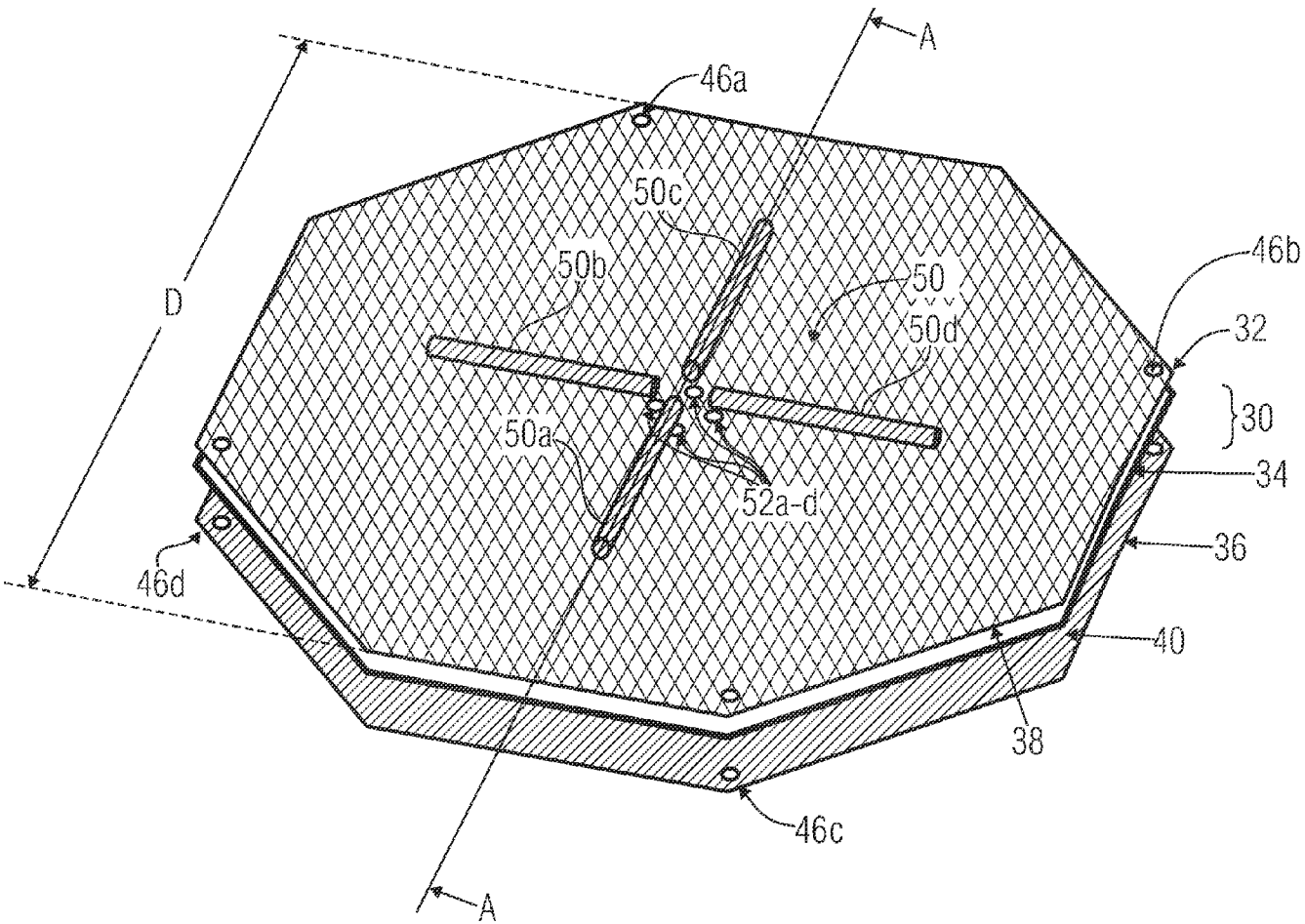
FIGS. 1*a-b* show a three-dimensional representation and an associated sectional representation of a leaky-wave antenna in accordance with an embodiment of the present invention.

Before the embodiments of the present invention will be explained in more detail below with reference to the figures, it shall be noted that in the embodiments illustrated below, elements that are identical or identical in function are designated by the same reference numerals in the figures. Therefore, descriptions of elements having the same reference numerals in the various embodiments are mutually exchangeable and/or mutually applicable.

Figure 1B:
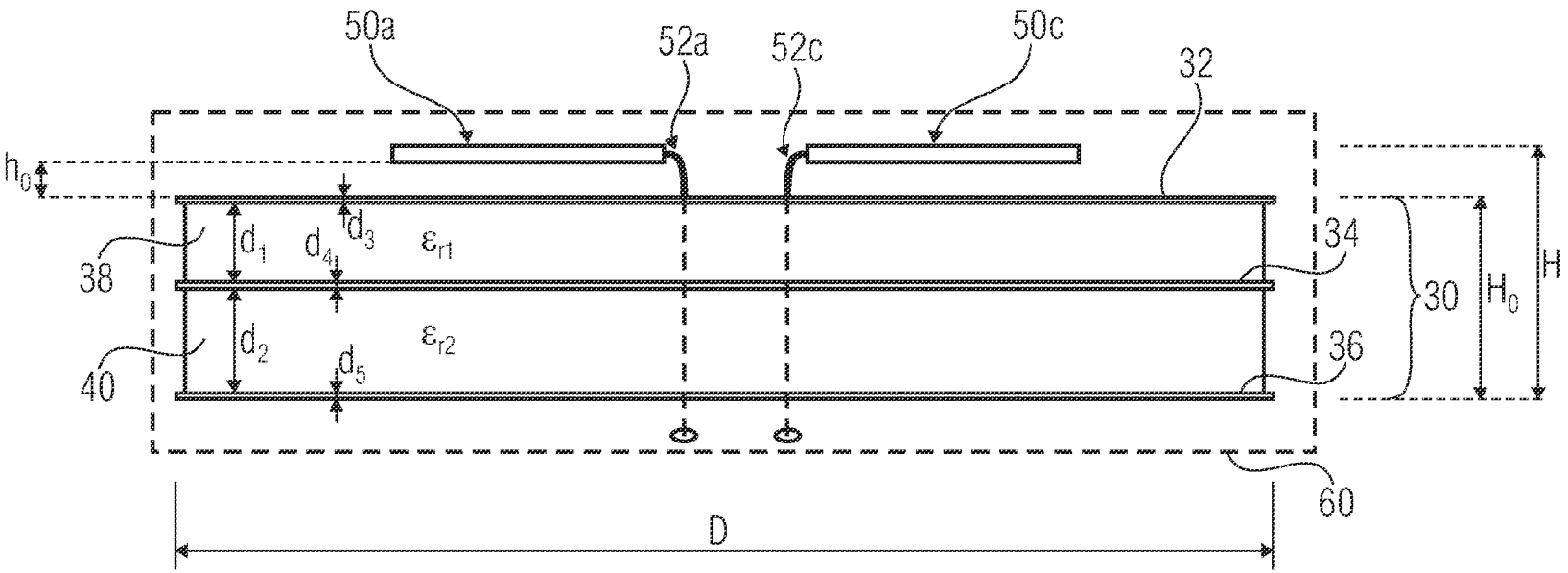

A first embodiment of an inventive leaky-wave antenna will now be described in detail with reference to FIGS. 1*a-b*, FIG. 1*a* representing a three-dimensional representation of the leaky-wave antenna 10, and FIG. 1*b* representing a sectional view along the line AA through the leaky-wave antenna 10.

As is depicted in FIGS. 1*a-b*, the leaky-wave antenna 10 comprises a sheet arrangement 30 having first, second and third metalized sheets 32, 34, 36 which are arranged on top of and in parallel with one another in an aligned manner in each case and are separated by a dielectric layer 38 between the first and second metalized sheets and by a dielectric layer 40 between the second and third metalized sheets. The first metalized sheet 32 has a first periodic metalization structure; in FIG. 1*a*, a periodic structure of the metalization 32 is achieved by means of separation gaps (or trenches or columns) 32*a*, said periodic structure, depicted in FIG. 1*a*, leading to a multitude of rectangular or square individual metalization elements 32*b*. The second metalized sheet 34 further comprises a second, two-dimensionally periodic metalization structure, which again is achieved by separation gaps 34*b* in the respective metalized sheet 34 with a multitude of further individual metalization elements.

As will be explained in detail below, the individual metalization elements may be rotated by an angle of e.g. 45° (or intermediate angles of between 0° and 90°) the first metalized sheet 32 towards the individual metalization elements of the second metalized sheet 34. Alternatively or additionally, the centers of the surface areas of the metalization elements of the first and second metalized sheets 32, 34 may be offset relative to one another (e.g. relative to an axis of symmetry, or orthogonally).

The third metalized sheet 40 has a continuous metalization area and is completely continuously metalized, for example.

In addition, an excitation structure 50 is arranged above the first metalized sheet 32 and on a side of the first metalized sheet 32 that is opposite the second metalized sheet 34, for exciting a leaky-wave mode of the sheet arrangement 30 at a working frequency $f_0$ of the leaky-wave antenna 10.

As is shown in FIGS. 1*a-b*, the first dielectric layer 38 has a thickness $d_1$ and a relative permittivity $\in_{r1}$. The second dielectric layer 40 has a thickness $d_2$ and an electric permittivity $\in_{r2}$. The first metalized sheet 32 has a thickness $d_3$, the second metalized sheet 34 has a thickness $d_4$, and the third metalized sheet 36 has a thickness $d_5$. The leaky-wave antenna 10 has an overall diameter D between two opposite sides. The dipole arms of the excitation structure 50 are arranged at a height $h_0$ above the first metalized sheet 32. The overall height of the leaky-wave antenna 10 is H between the excitation structure 50 and the third metalization sheet 38.

As is depicted in FIGS. 1*a-b*, the excitation structure 50 is depicted, for example, as a cross-dipole structure centrally arranged on the sheet arrangement 30, its feeding points 52*a-d* being arranged in the sheet arrangement such that they are symmetrical to one another and centered. However, it should become apparent that depending on the case of application and implementation, other excitation structures may be used for exciting a leaky-wave mode in the sheet arrangement 30 of the leaky-wave antenna 10; other positions than being centered on the sheet arrangement are also feasible. In addition, it is also feasible for the feeding points for the dipole arms of the cross-dipole structure to be located on the opposite side of the individual dipole arms, respectively, i.e. located on that side of the dipole arms which faces the antenna edge, rather than on that side which faces the antenna center, respectively.

Due to ease of excitation of the leaky-wave antenna by, e.g., two crossed dipoles, the expenditure for the useful feeding network for the excitation structure may be kept relatively low.

As is also depicted in FIG. 1*b*, the leaky-wave antenna 10 may optionally comprise a package 60 for protecting the sheet arrangement and the excitation structure against mechanical or other environmental influences.

The sheet arrangement 30, depicted in FIG. 1*a*, of the leaky-wave antenna has, e.g. as an edge boundary, the shape of a regular octagon, whereby azimuth-independent propagation of the leaky wave and, thus, a conical directional effect of the leaky-wave antenna 10 is achieved. In addition to the regular octagon depicted in FIG. 1*a*, other regular n-gons may also be employed, such as the decagon (regular decagon) or the dodecagon (regular dodecagon), etc., up to approximately circular or exactly circular floor spaces.

With regard to the present invention, it is to be noted that as the edge boundary for the sheet arrangement 30, any shape of a regular n-gon N≥8 (with N ∈Z) or a circular shape may be selected so as to achieve the electric characteristics of the leaky-wave antenna 10 that will be depicted in the following. If a polygon, or n-gon, has identical sides and identical interior angles, it will be referred to as a regular n-gon. Regular polygons are isogonal, i.e. their corners are situated on a circle at slight distances, i.e. at an identical zenith angle.

Thus, the lateral dimensions, i.e. the edge boundary of the sheet arrangement 30 of the leaky-wave antenna 10, represent one of the design parameters of the leaky-wave antenna, and also determine the directivity characteristic of the leaky-wave antenna 10 in addition to the dispersion behavior of the antenna structure, it being possible to set the shape and beamwidth of the directivity characteristic of the inventive leaky-wave antenna by dimensioning the sheet arrangement in a targeted manner.

Figure 9A:
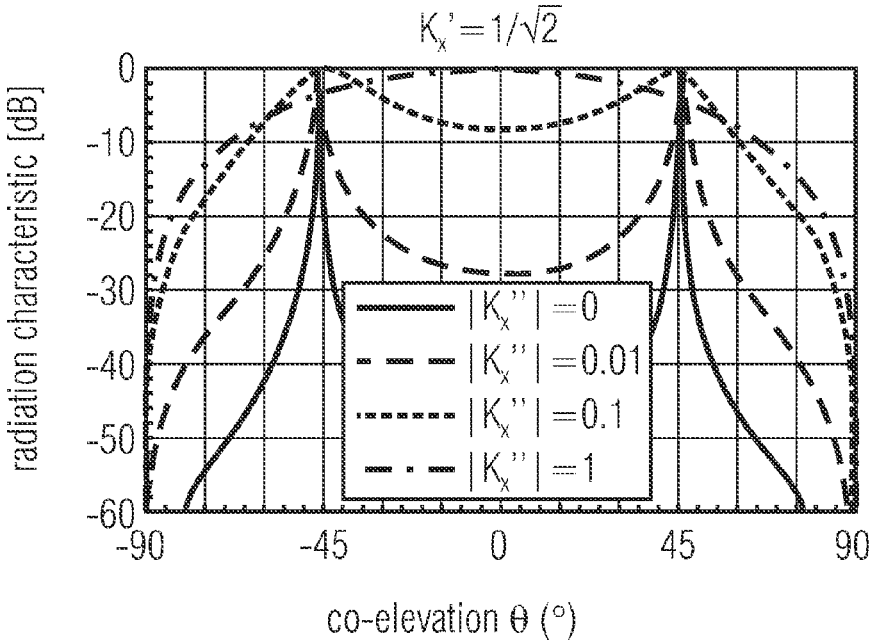
FIGS. 9*a-b* show calculated far-fields distributions for an infinite periodic structure and a finite periodic structure as a function of the co-elevation angle θ.
Figure 9B:
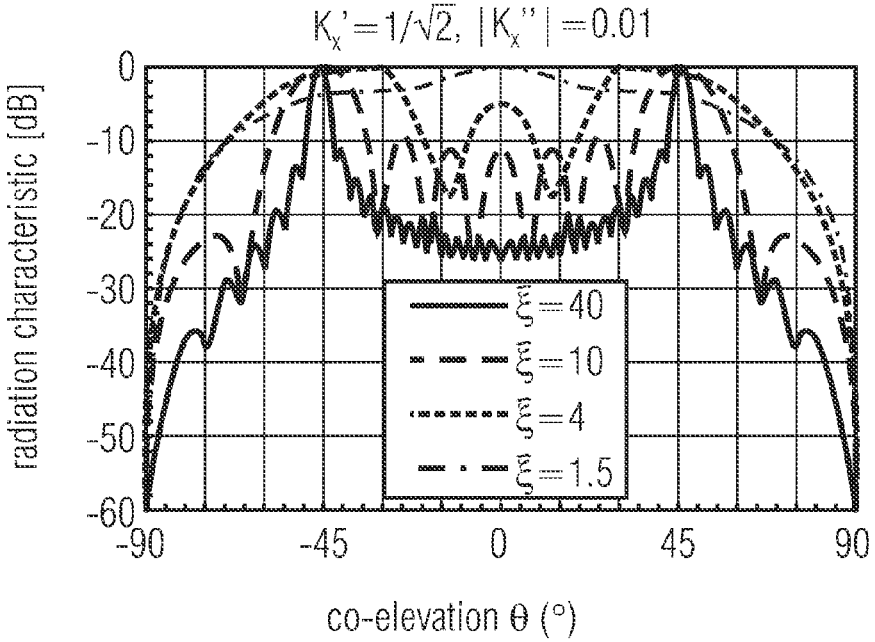

FIGS. 9*a-b* shall now be dealt with in more detail below in order to illustrate the effect of the lateral delimitation of the structured sheet arrangement 30 for setting the radiation characteristic of the inventive leaky-wave antenna 10 in a targeted manner.

In order to simplify things, it shall initially be assumed that a structure has a periodicity in a direction, e.g. in the x direction in the plane of the sheet arrangement. The solution of the wave equation is then given by the sum of an infinite set of space harmonics that differ by their wave numbers.

$$k_{x,n} = k'_{x,n} - jk''_x = k_{x,0} + \frac{2\pi}{a}n,\ n \in > Z, \tag{1}$$

wherein $k_{x,0}$ indicates the wave number of the fundamental wave, and a indicates the periodicity along the x direction (in the one-dimensional case).

If there is at least a result n=n', wherein $k'_{x,n'} < k_0$ ($k_0$ being the wave number of the free-space propagation), the corresponding spatial fundamental wave will be a so-called fast wave and may therefore couple into a leaky wave which radiates in the following direction:

$$\theta_m = \arcsin\left(\frac{k'_{x,n'}}{k_0}\right), \tag{2}$$

wherein $\theta_m$ is the angle measured from the normal to the surface. The condition for leaky-wave radiation follows directly from the above relationship 2, since $\theta_m$ will only occur if $k'_{x,n} \leq k_0$.

FIG. 9*a* depicts a calculated far-field distribution for an infinite periodic structure as a function of θ. The values are normalized to the maximum amplitude, the attenuation constant in the amount $K''_x$ serving as a parameter. FIG. 9*a* then shows the influence of the attenuation constant on the radiation pattern, which is plotted as a function of the co-elevation angle θ=arcsin (k) of a periodic structure excited in case of x=0 (one-dimensional case). As an example, $K'_x = 1/\sqrt{2}$ was selected, so that in accordance with the above relationship (2), both maxima occur at θ=45° and at θ=−45°.

In the event of low attenuation $|K''_x| \ll 1$, the assumption holds. For $|K''_x| \approx 1$, the two maxima become weaker and are shifted in the direction θ=0°, i.e. in the direction perpendicular to the structure.

In the event of a finite (limited) periodic structure, the field distribution (of a non-limited structure) may be weighted by a regular window function. Assuming that no reflections arise from the structure being limited, FIG. 9*b* shows that limiting the periodic structure effects a shift of the two beams in the direction θ=0. FIG. 9*b* shows the calculated far-field distribution for a finite periodic structure as a function of θ. The values are normalized to the maximum amplitude, the size of the structure (determined by ξ) serving as a parameter.

It should become apparent from the above illustrations that with the inventive leaky-wave antenna, on account of the selected floor space of the sheet arrangement 30 in the form of a regular n-gon, an azimuth-independent propagation of the leaky wave in the sheet arrangement 30 may be achieved, and that on account of the provision of a multitude of individual metalization elements 32*b*, 34*b*, or unit cells, an (approximately) non-directional dispersion characteristic of the sheet arrangement may be achieved at the working frequency of the leaky-wave antenna 10.

On the basis of the wave number, predefined by the sheet arrangement, for a leaky-wave mode excited in the sheet arrangement at the working frequency of the leaky-wave antenna 30, the main direction of radiation, or directivity characteristic, of the inventive leaky-wave antenna 10 may be set. As was already indicated above, the beamwidth of the radiation characteristic of the inventive leaky-wave antenna may be set, or specified, via the size of the overall structure, i.e. via the lateral dimensions of the sheet arrangement 30.

In accordance with the present invention, the radiation characteristic of the leaky-wave antenna 10 shown in FIG. 1*a* may thus be set in a targeted manner on the basis of utilization of the radiation properties of leaky waves, on the one hand, and on the basis of targeted delimitation with regard to the shape and lateral extension of the structured surface, i.e. of the sheet arrangement 30, on the other hand.

In accordance with embodiments of the inventive leaky-wave antenna 10, the sheet arrangement 30 has, e.g., an overall diameter D with regard to a distance of two opposite sides of the n-gon (or of the circle diameter of the sheet arrangement 30) of less than 10 or 5 times the value (or, e.g., 3 times the value) of the free-space length wave $\lambda_0$ of the leaky-wave antenna at the working frequency $f_0$ or within the working frequency range $\Delta f_0$.

As is further depicted in FIG. 1*a*, the first metalization structure 32 has a multitude of individual metalization elements 32*b*, said individual metalization elements 32*b* comprising a lateral dimension "a" that is smaller than or equal to one tenth (1/10) of the free-space wave-length $\lambda_0$ of the leaky-wave antenna 10 at its working frequency $f_0$. In addition, the second metalization structure 34 has a multitude of further individual metalization elements 34*b*, said further individual metalization elements 34*b* also having a lateral (or diagonal) dimension that is smaller than or equal to one tenth of the free-space wavelength $\lambda_0$ of the leaky-wave antenna 10 at the working frequency $f_0$.

In this context, the free-space wavelength $\lambda_0$ is assumed to be, for example, the smallest occurring free-space wavelength $\lambda_0$ of the present leaky-wave antenna 10 at the respective working frequency $f_0$. Thus, an (approximately) non-directional (i.e. azimuth-independent) dispersion characteristic is achieved in the sheet arrangement 30 of the leaky-wave antenna 10 in the plane of the sheet arrangement 30.

For this purpose, the sheet arrangement 30 has, e.g., a lateral extension having less than, e.g., 100, 50, or 30 individual metalization elements 32*b* of the first metalized sheet 30 along a distance of two opposite sides of the n-gon or of the circle diameter of the sheet arrangement 30.

In this context, it shall be noted with reference to FIG. 1*a* that the individual metalization elements 32*b* and 34*b*, respectively, of the first and second metalized sheets 32, 34 may be partly cut off at the edge region, for example due to the shape of the edge boundary of the sheet arrangement; however, this only applies to the last individual metalization elements, respectively, of the different metalized sheets. In addition, it shall be noted with reference to FIG. 1*a* that the four bores or holes 46*a-d* represented there may be provided at the edges for mounting purposes.

The leaky-wave antenna depicted in FIGS. 1*a-b* is thus constructed, in accordance with the invention, from a multitude of adjacently arranged unit cells, each unit cell having to be regarded as an area that corresponds, in terms of the floor space of a single individual metalization element of the first metalized sheet 32, to a (vertical) projection through the sheet arrangement 30. The architecture of unit cells will be addressed in detail below.

As was already briefly mentioned above, excitation in the sheet arrangement 30 of the leaky-wave antenna 10 of a leaky-wave mode is effected while using the excitation structure arranged above the first metalized sheet 30. As is depicted in FIG. 1*a*, this excitation structure 50 may be implemented, for example, by two dipoles 50*a*, 50*b* arranged in a cross shape and centrally arranged above the surface of the sheet arrangement 30.

Depending on the feed of the individual dipoles, linearly, cross-, or circularly polarized waves may be excited in the sheet arrangement 30 of the leaky-wave antenna 10. In this context, it shall once again be noted that any excitation structures and/or antenna arrangements may be employed by means of which waves that are polarized in such a manner may be excited in the sheet arrangement.

As is depicted in FIGS. 1*a-b*, the height H of the entire arrangement of the leaky-wave antenna 10 may be configured to be clearly smaller than the wavelength $\lambda_0$ in the working frequency range $\Delta f_0$, so that the antenna may be considered as being planar. For example, in a frequency range at 2.2 GHz, the height H of the arrangement may range from 4 to 10 mm, for example, said height H being clearly smaller than the wavelength $\lambda_0$ of 13.6 cm at 2.2 GHz. In addition, a diameter D of the leaky-wave antenna of less than 40.8 cm results for a lateral dimension of less than $3\lambda_0$.

What is particularly advantageous is that the sheet arrangement 30 of the leaky-wave antenna may technically be regarded as a multi-sheet printed circuit board, so that it may be manufactured by using established manufacturing processes. By means of suitable substrate materials and/or technologies, conforming implementations of the leaky-wave antenna 10, i.e. implementations that are adjusted to curved surfaces, are possible.

It may thus be stated in summary that the antenna has a low constructional height H of, e.g., less than 10 or 6 mm. It may therefore be mounted on or integrated into planar surfaces. Even though the inventive leaky-wave antenna 10 is based on the propagation of leaky waves, it has small transverse dimensions ($D \leq 3\lambda_0$). In particular, the structure of the leaky-wave antenna 10 may be designed with regard to two degrees of freedom. In accordance with the leaky-wave mode excited in the sheet arrangement and/or with the wave number of the leaky wave excited, the main direction of radiation of the leaky-wave antenna 10 may be predefined (in accordance with the above relationship 2). In addition, the beamwidth of the radiation characteristic may be adjusted using the size of the overall structure, i.e. the lateral dimensions and the edge boundary as are provided in accordance with the invention.

Different design possibilities and/or different implementations of the inventive leaky-wave antenna 10 will be discussed below by way of example using the additional figures (while taking into account the above general illustrations). The working frequencies $f_0$ or working frequency ranges $\Delta f_0$ presented below as well as the selected materials and their properties as well as the selected sizes and dimensions of the individual structures and arrangements therefore represent only exemplary embodiments and possibilities of realizing the inventive leaky-wave antenna. Basically, the inventive approach to implementing the inventive leaky-wave antenna 10 on the basis of exploitation of the radiation characteristics of leaky waves, on the one hand, and on the basis of delimitation (with regard to lateral dimensions and to the edge boundary) of the structured surface (of the sheet arrangement 30), on the other hand, for setting the radiation characteristic in a targeted manner may be used independently of the respective working frequency and/or the addressed service, however, and may result in different implementations of the inventive leaky-wave antenna.

The architecture of an inventive leaky-wave antenna 10 will be explained with reference to FIGS. 2*a-b*, which represent a schematic diagram of an exemplary unit cell 70 of the inventive leaky-wave antenna 10, and with reference to FIGS. 3*a-b*, each of which represents a section from the layout of the first metalized sheet 32 comprising the individual metalization elements 32*b*, and of the second metalized sheet 34 comprising the further individual metalization elements 34*b*, both of which are structured periodically.

Figures 2A, 2B:
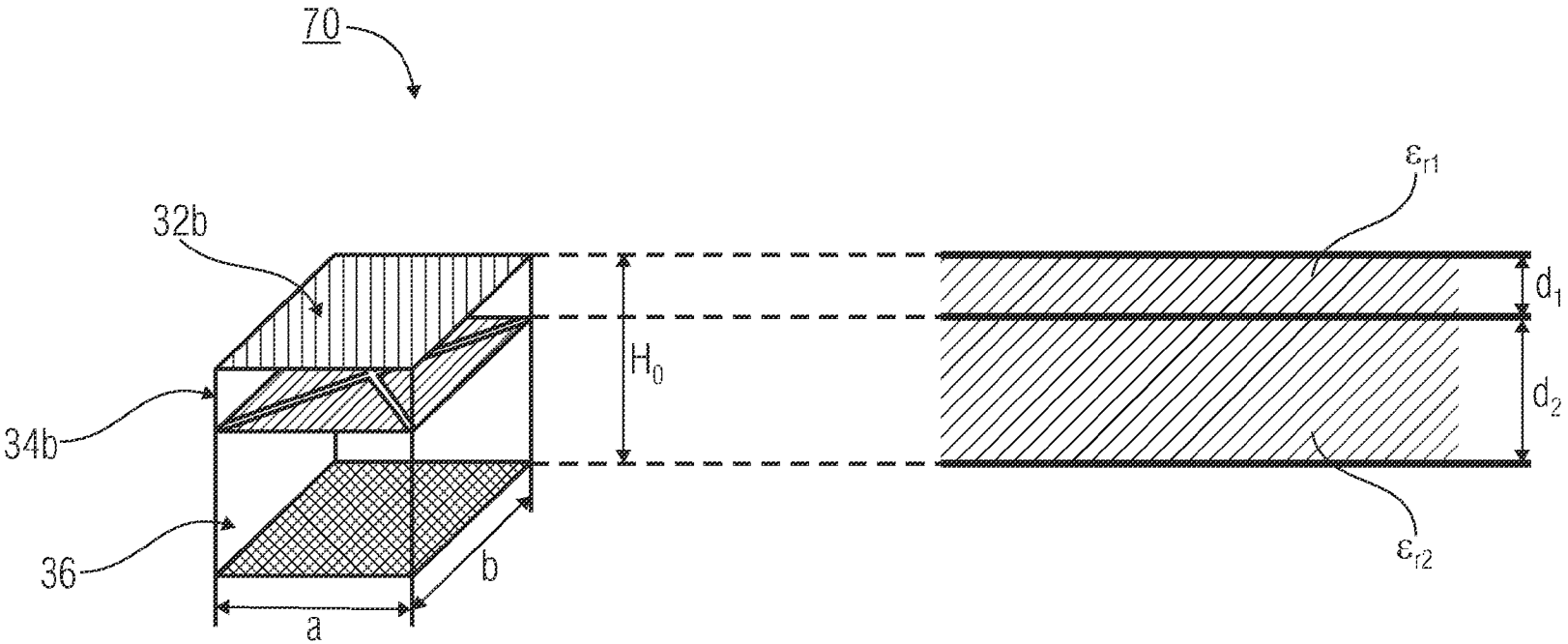
FIGS. 2*a-b* show a schematic diagram of an exemplary individual cell of a leaky-wave antenna in accordance with an embodiment of the present invention.

As is depicted in FIG. 2*a*, a unit cell is to be regarded as an area of the periodic structure which corresponds, with regard to the floor space of a single individual metalization element 32*b* of the first metalization sheet 32, to a projection through the sheet arrangement 30.

Figure 3B:
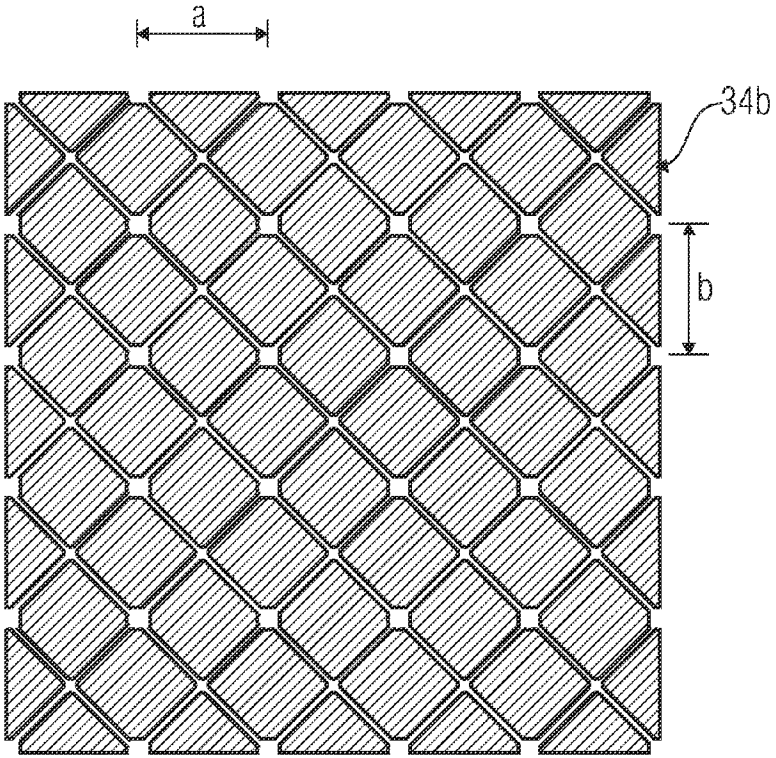
FIGS. 3*a-b* show schematic diagrams of the periodic metalization structures of the first and second metalized sheets in accordance with an embodiment of the present invention.
Figure 3A:
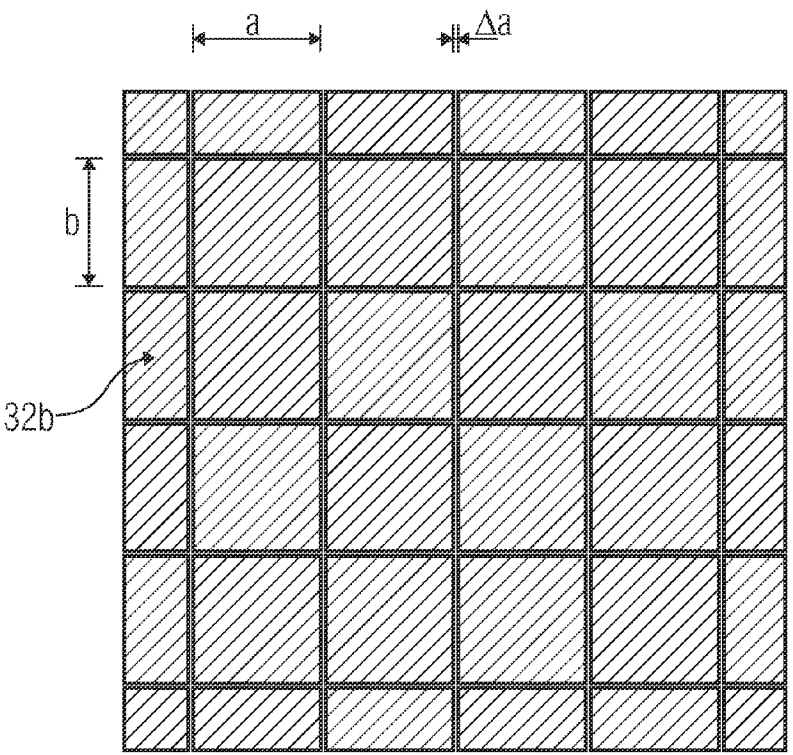

As is depicted in FIGS. 2*a-b* and 3*a-b*, a unit cell has a floor space that comprises the lateral lengths a and b (e.g. a=b); under the assumption "a=b" for the two-dimensional periodicity of the metalization structures 32 and 34, this dimension "a" may be considered. As is depicted in FIGS. 3*a-b*, the individual metalization elements 32*b*, 34*b*, are configured to be rectangular or square, the periodicity of the individual metalization elements of the first metalized sheet 32 being rotated by an angle of 45° with regard to the periodicity of the further individual metalization elements of the second metalized sheet 34. Thus, the area centers of the individual metalization elements of the first metalized sheet 32 coincide with the crossing points of the separation gap lines of the further individual metalization elements 34*b* of the second metalized sheet 34.

It shall be noted in this context that this torsion angle of 45° with regard to the periodicity is to be considered as being exemplary, and that other torsion angles may also be used, e.g. 30°, 60°, 90°. Moreover, it will also be explained below that a mutual shift of the first and second metalized sheets 32, 34, or a shift in their periodicities or their area centers with regard to an axis of symmetry, e.g. orthogonally, may be provided.

FIG. 2*b* additionally depicts that the first dielectric layer 38 having the thickness $d_1$ and a relative permeability $\in_{r1}$ is arranged between the first and second metalized sheets, whereas the second dielectric layer 40 having the thickness $d_2$ and a relative permeability $\in_{r2}$ is arranged between the second metalized sheet 34 and the third metalized sheet 38.

In the following, an operating frequency range $\Delta f_0$ of the inventive leaky-wave antenna of 2170-2200 MHz shall be assumed by way of example. The different dimensions and electric parameters of the inventive leaky-wave antenna 10 are implemented to implement a radiation maximum independently of the azimuth at an elevation of 45° with a 3 dB beamwidth of 30°. A value of about 4 dBi is predefined as the gain, for example in the case of circular polarization.

In order to implement these antenna characteristics for the inventive leaky-wave antenna 10, the unit cells depicted in FIGS. 2*a-b* and 3*a-b* may be sized as follows. The first dielectric layer (carrier substrate) has a thickness $d_1$ of 0.102 mm, for example, and a relative permittivity $\in_{r1}$ of 3.54. The second dielectric layer 40 (carrier substrate 40) arranged between the second and third metalized sheets 34, 36 has a thickness $d_2$ of 3.150 mm and a relative permittivity $\in_{r2}$ of 3.55, for example. The topmost sheet, i.e. the first metalized sheet 32, and the interior sheet, i.e. the second metalized sheet 34, are periodically structured, sections of the corresponding layouts of the two-dimensional periodic metalization structures being depicted in FIGS. 3*a-b*. For example, between adjacent metalized elements there is a separation line or separation gap having a width Δa of 0.2 mm. The bottommost sheet, i.e. the third metalized sheet 36, is continuously metalized (at least in some areas) and serves as a ground plane that has the reference potential, for example. The thicknesses $d_3$, $d_4$, $d_5$ of the metalizations of all three sheets thus are at 0.035 mm. The overall height $H_0$ of the unit cells 70 thus amounts to 3.357 mm.

The periodicity (period) of the structure, i.e. the edge length a of the unit cell, is 6.35 mm and is thus smaller, by a factor of 21, than the smallest occurring free-space wavelength in the contemplated working frequency range $\Delta f_0$ ($f_{0\text{-}max}$=2.2 GHz→$\lambda_{0\text{-}min}$=13.6 cm). Due to these dimensions with regard to the free-space wavelength $\lambda_0$, an almost independent dispersion characteristic of the azimuth angle is implemented in the sheet arrangement 30. All in all, the unit cell 70 was dimensioned such that the wave number k (with $K=k/k_0$) of the leaky wave has a real part (phase constant β) of 2π 0.98/λ at 2.19 GHz.

The diameter D of the overall structure, i.e. the distance of two opposite sides of the octagonal boundary wall, is 204.6 mm. Thus, there are 30 unit cells between the opposite, mutually parallel segments (lateral lines) of the octagon.

The arms 50*a-d* of the cross-dipole arrangement 50 are arranged to be centered and at a distance $h_0$ of 2.0 mm above the surface of the first metalized sheet 32, and are excited by four feed points 50*a-d* introduced into the structure, i.e. into the sheet arrangement 30. The height H of the entire antenna arrangement thus amounts to 5.4 mm (5.357 mm).

As was already indicated above, the leaky-wave antenna 10, i.e. the sheet arrangement 30 and the excitation structure 50, may also be surrounded by a package 60.

Figure 4:
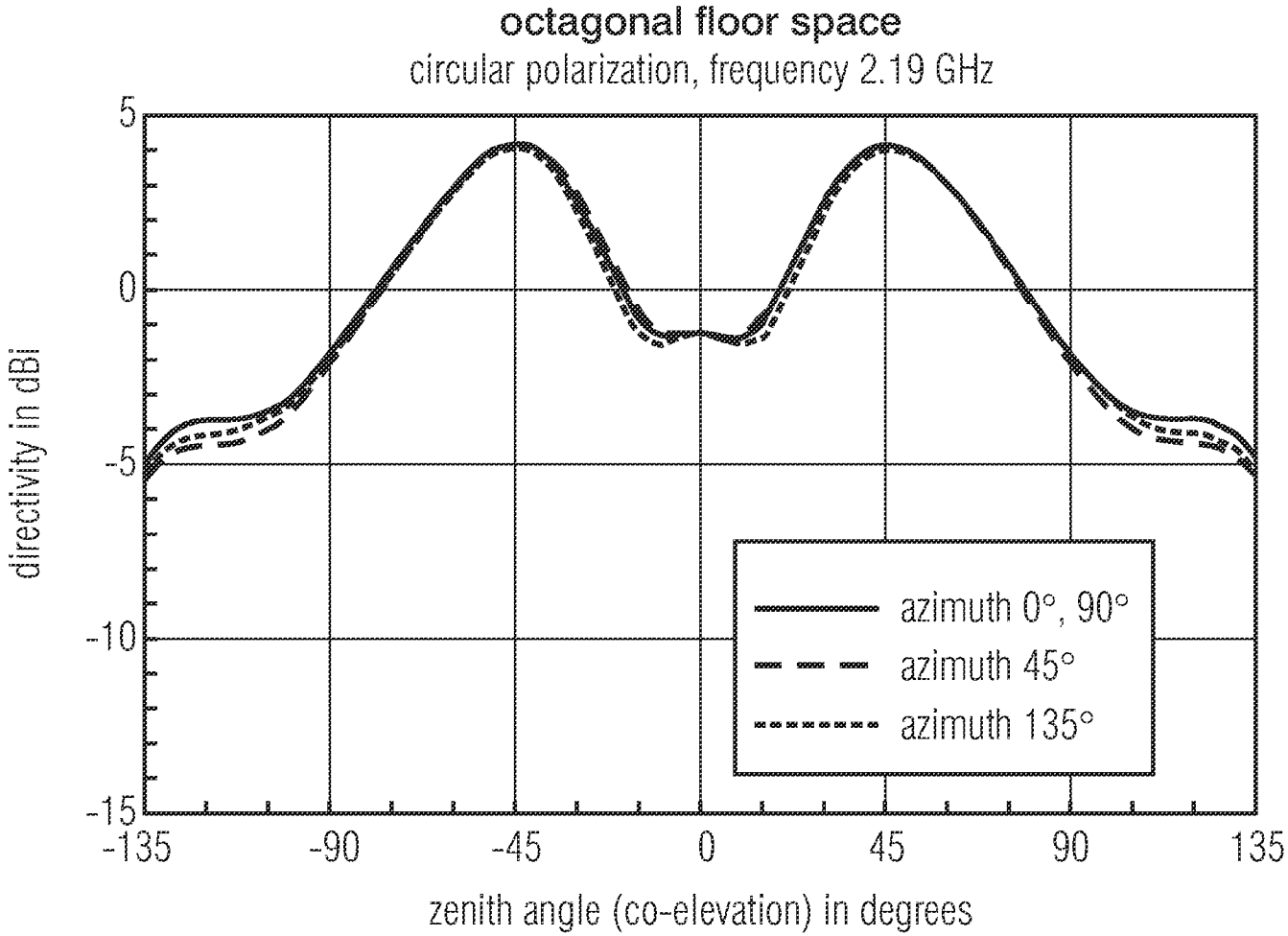
FIG. 4 shows the directivity of the leaky-wave antenna in accordance with an embodiment of the present invention.
Figure 5:
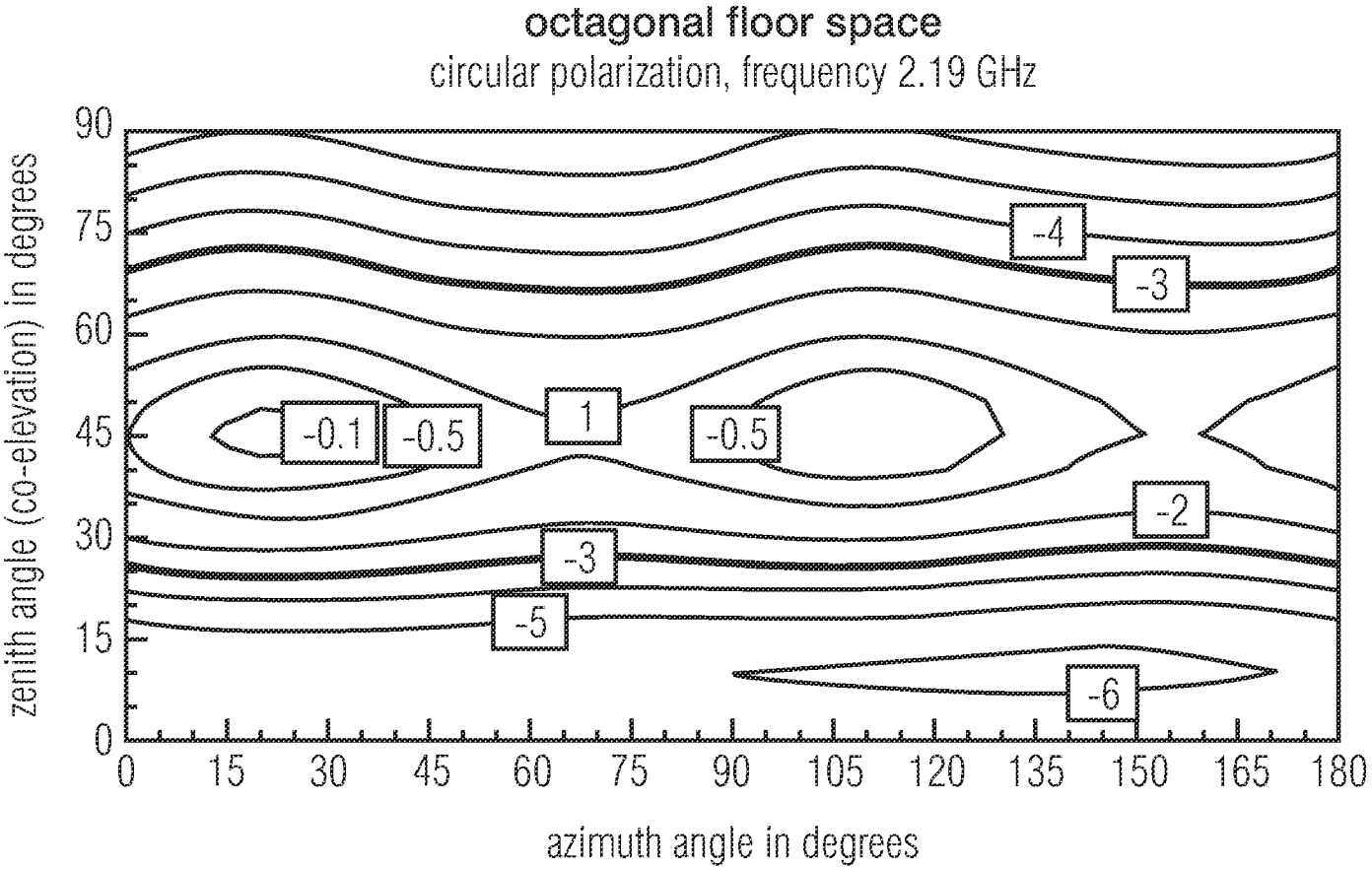
FIG. 5 shows contour lines of the directivity of the leaky-wave antenna in accordance with an embodiment of the present invention.

In FIG. 4, the directivity of the leaky-wave antenna 10 at a working frequency $f_0$ of 2.19 GHz is plotted over the zenith angle θ in degrees for various azimuth angles. FIG. 5 represents the contour lines of the directivity of the inventive leaky-wave antenna at 2.19 GHz, plotted over azimuth and zenith angles.

It shall be noted in this context that the directivity characteristic of the inventive leaky-wave antenna 10 was determined by means of simulation, the resulting far-field characteristics with circularly polarized radiation being depicted in FIGS. 4 and 5. In FIG. 4, various far-field portions at 2.19 GHz are plotted as a function of the zenith angle for constant azimuth angles. The individual curves are almost equivalent, which characterizes the conical directional effect of the inventive leaky-wave antenna 10. The maximum directivity of +4.7 dBi is achieved at the desired zenith angle of ±45°.

In FIG. 5, the framed values at the contour lines are related to the maximum of the directivity (in dB). The bold contour lines characterize the decrease of 3 dB in relation to the maximum. The directivity characteristic at 2.19 GHz in dependence on the azimuth and zenith angles is shown in the form of a contour diagram in FIG. 5. The desired 3 dB beamwidth of 30° is achieved over the entire azimuth range. Within the working frequency range contemplated, the directivity characteristics are equivalent both in qualitative and in quantitative terms. (No statements were made on the adaptation of the antenna and the gain by means of the simulation).

Figure 6:
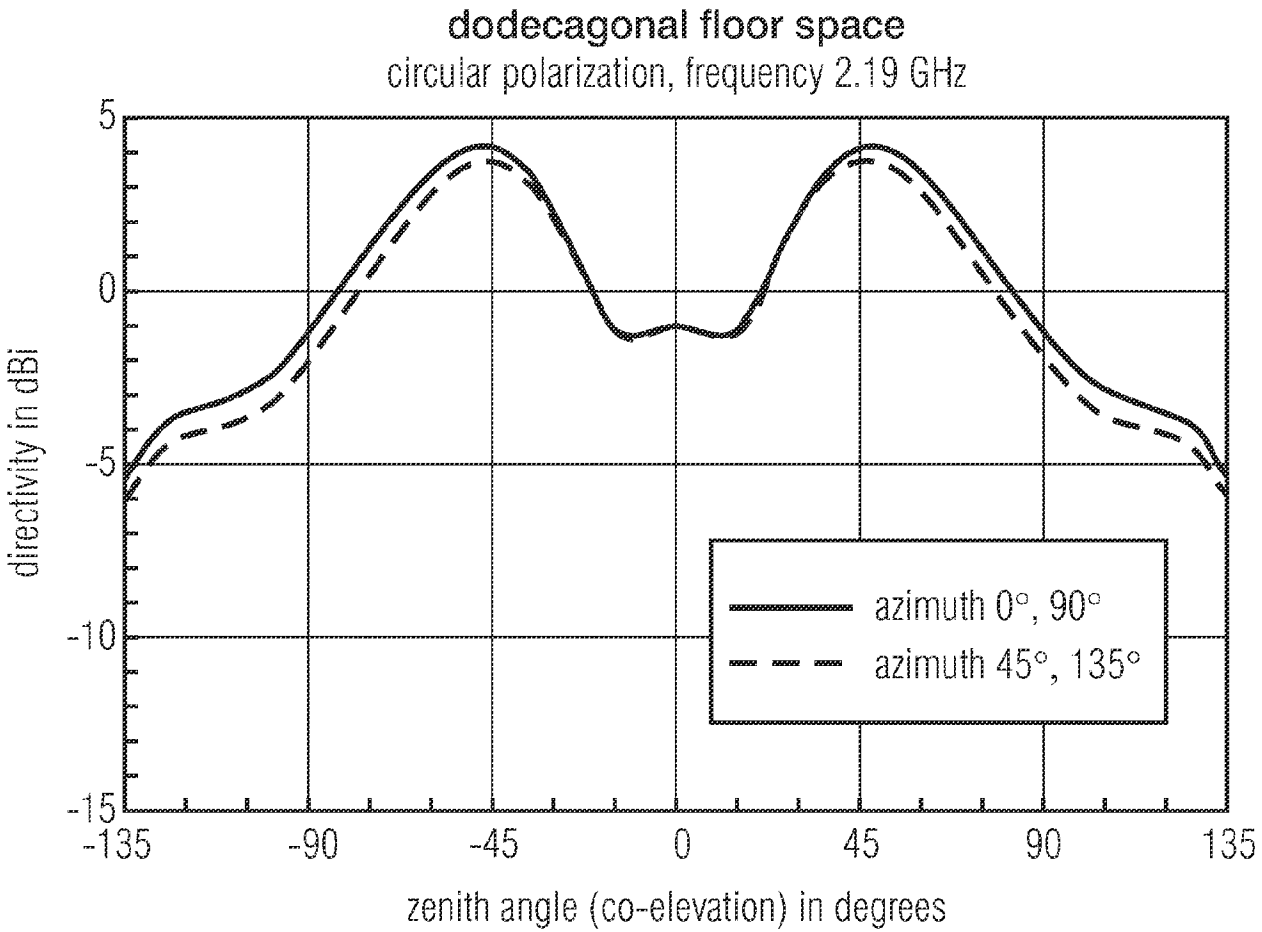
FIG. 6. shows a comparative example of the directivity of a leaky-wave antenna having a dodecagonal floor space at 2.19 GHz in accordance with an embodiment of the present invention.

As compared to the leaky-wave antenna 10 with an octagonal floor space, as is depicted in FIG. 1*a*, a leaky-wave antenna 10 with a dodecagonal floor space (dodecagon) is additionally simulated in FIG. 6.

FIG. 6 shows the far-field sections determined (directivity of the leaky-wave antenna with a dodecagonal floor space) at 2.19 Gigahertz as a function over the zenith angle for various azimuth angles. As may be gathered from FIG. 6, the azimuth dependency is low even in an inventive leaky-wave antenna having a dodecagonal floor space, this being true particularly in the area of the main lobes.

It shall be noted once again at this point that the implementations of different embodiments of the inventive leaky-wave antenna 10, which were discussed above with reference to FIGS. 2*a-b*, 3*a-b*, 4, 5, and 6, are tailored to specific applications, for example; applications at other frequencies or frequency ranges and, e.g., having different requirements placed upon the directivity characteristic (e.g. with a different main direction of radiation and/or beamwidth) may be addressed by means of the entire arrangement being scaled, i.e. by an adaptation of the dimensions of the unit cells 70, of the structure (sheet arrangement 30), and of the excitation elements 50.

The wavelength at the operating frequency serves as a reference value in this context, since the beamwidth does "not" depend on the absolute size of the overall structure, but on the relative size, i.e. the effective area, of the overall structure.

In order to adjust the dispersion characteristic to the structure, i.e. to the leaky-wave antenna or sheet arrangement 30, a decrease or increase in the lateral dimensions of the unit cell may be used as the working frequency increases and decreases, respectively. An adaptation to a working frequency $f_0$ of, e.g., 2.9 GHz would entail, e.g., a reduction of the period "a" to 4.7 mm (as compared to 6.35 mm at 2.19 GHz), provided that the other dimensions of the unit cell 70 remain unchanged.

Figure 7:
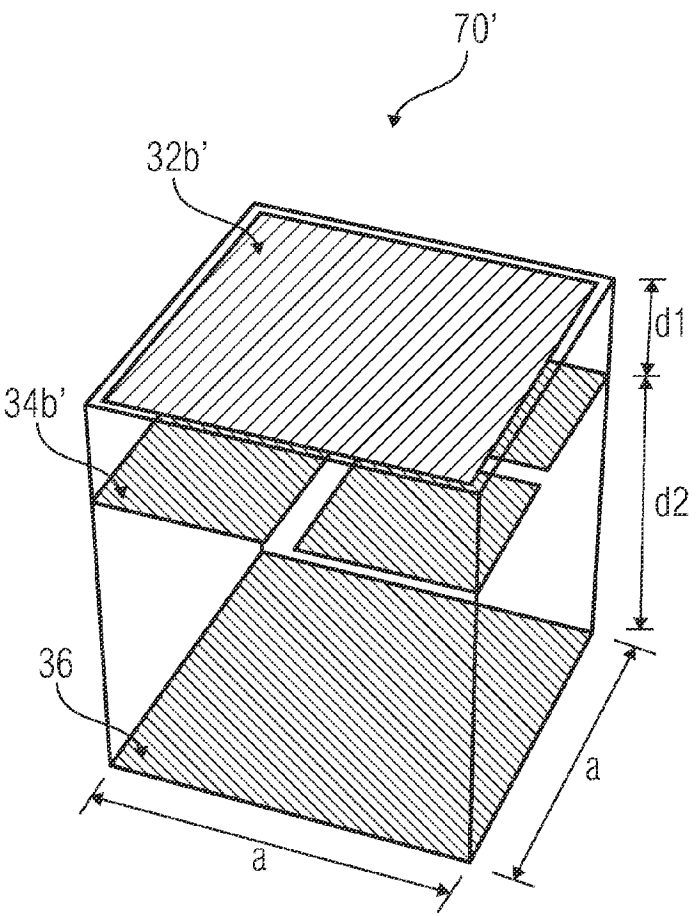
FIG. 7 shows a schematic diagram of an exemplary individual cell with the representations of the periodic metalization structures of the first and second metalized sheets in accordance with a further embodiment of the present invention.

A further realization of a unit cell for the inventive leaky-wave antenna 10, which also ensures azimuth-independent source propagation in the sheet arrangement 30, will be represented below with reference to FIG. 7. FIG. 7 shows a unit cell 70', which may also be used as a basis for a leaky-wave structure. FIG. 7 shows a section of the two-dimensionally periodic metalization structure 32' of the first metalized sheet 32, and further a section of the second two-dimensional periodic metalization structure **34*b*'** of the second metalized sheet.

As is shown in FIG. 7, the area centers of the further metalization elements **34*b*' of the second metalized sheet are offset from the area centers of the individual metalization elements 32*b*'** of the first metalization sheet, said offset being provided, in the present case, to be orthogonal and to amount to half a period length (a/2).

Figure 8:
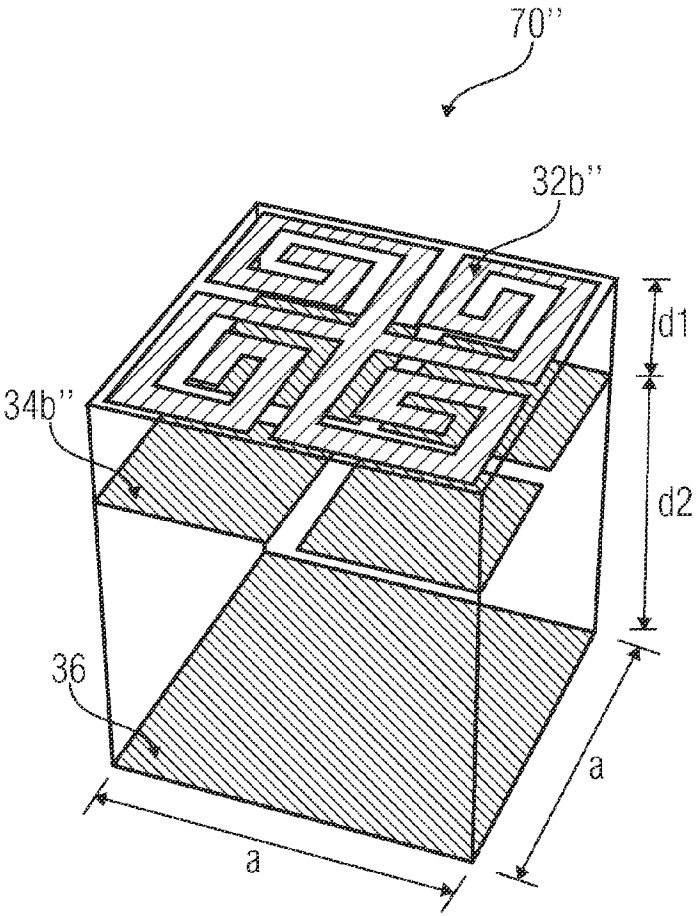
FIG. 8 shows a schematic diagram of an exemplary individual cell of a leaky-wave antenna and the associated representations of the periodic metalization structures of the first and second metalized sheets in accordance with a further embodiment of the present invention.

FIG. 8 shows a schematic diagram of a unit cell 70", which may also be used as a basis of a leaky-wave structure for the inventive leaky-wave antenna 10. In FIG. 8, too, only the metalized elements are depicted.

As is shown in FIG. 8, the first two-dimensionally periodical metalization structure **32*b*" of the first metalized sheet is configured to be spiral-shaped, four spiral arms extending from the area center. The second metalization sheet of the unit cell 70" of FIG. 8 corresponds to the second metalization sheet of the unit cell 70' of FIG. 7**.

With regard to the metalization structures or sheet arrangements, illustrated above, for an inventive leaky-wave antenna 10, care is to be taken to ensure that the power provided by the excitation structure 50 also transitions to the desired leaky-wave modes within the sheet arrangement 30. In addition, care is to be taken to ensure, with regard to the unit cells depicted in FIGS. **2*a*-*b*, 7 and 8, that excitation by the excitation structure 15** transitions to azimuth-independent propagation of the leaky wave within the sheet arrangement, i.e. that the sheet arrangement supports propagation of a desired leaky-wave mode.

In summary, it may be stated with regard to the embodiments represented that the inventive leaky-wave antenna has a small height, for example a height of less than 6 mm at a working frequency of about 2.2 GHz. Therefore, the inventive leaky-wave antenna may either be mounted on or integrated into planar surfaces. Even though the leaky-wave antenna is based on the propagation of leaky waves, it exhibits low transverse measurements and, thus, a small overall surface area as compared to conventional leaky-wave antennas.

For dimensioning the leaky-wave antenna, one may resort to two degrees of freedom, in particular. For example, the wave number of the leaky wave may be set by means of the implementation of the periodic metalization structures of the sheet arrangement, whereby the main direction of radiation of the leaky-wave antenna may be specified. In addition, the beam-width in the main direction of radiation of the leaky-wave antenna may be influenced by the size and shape of the overall structure.

In accordance with embodiments, the inventive leaky-wave antenna supports linear and circular polarizations as well as cross-polarization of the excited leaky wave in the sheet arrangement. With circularly polarized waves, the antenna has a conical directivity characteristic.

It is also be noted that due to the ease of excitation of the leaky-wave antenna by two crossed dipoles, the expenditure entailed by the useful feed network for the excitation structure is low. In addition, the leaky-wave antenna may be realized as a multi-sheet printed circuit board and may therefore be manufactured in a straightforward manner.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

The invention claimed is:

1. A leaky-wave antenna comprising:

a sheet arrangement comprising first, second and third metalized sheets that are arranged on top of and in parallel with one another and are separated from one another by two di-electric layers;

the first metalized sheet comprising a first two-dimensionally periodic metalization structure, the second metalized sheet comprising a second two-dimensionally periodic metalization structure, and the third metalized sheet comprising a continuous metalization area; and an excitation structure above the first metalized sheet for exciting a leaky-wave mode in the sheet arrangement at a working frequency $f_0$ of the leaky-wave antenna;

wherein the sheet arrangement exhibits a shape of a regular n-gon with $N \geq 8$ ($N \in Z$) or a circular shape as the edge boundary.

2. The leaky-wave antenna as claimed in claim 1, wherein the sheet arrangement comprises an overall diameter D—with regard to a distance of two opposite sides of the n-gon or of the circle diameter of the sheet arrangement—of less than 5 times the value of the free-space wavelength $\lambda_o$ of the leaky-wave antenna at the working frequency $f_0$.

3. The leaky-wave antenna as claimed in claim 1, wherein the first metalization structure comprises a multitude of individual metalization elements, said individual metalization elements comprising a lateral dimension smaller than or equal to 1/10 of the free-space wavelength $\lambda_o$ of the leaky-wave antenna at the operating frequency $f_0$.

4. The leaky-wave antenna as claimed in claim 1, wherein the second metalization structure comprises a multitude of further individual metalization elements, said further individual metalization elements comprising a lateral dimension that is smaller than or equal to 1/10 of the free-space wavelength $\lambda_o$ of the leaky-wave antenna at the working frequency $f_0$.

5. The leaky-wave antenna as claimed in claim 3, wherein the sheet arrangement comprises a lateral extension D that comprises less than 50 individual metalization elements of the first metalized sheet along a distance of two opposite sides of the n-gon or of the circle diameter of the sheet arrangement.

6. The leaky-wave antenna as claimed in claim 1, wherein the sheet arrangement is configured as a periodically structured multi-sheet printed circuit board.

7. The leaky-wave antenna as claimed in claim 1, wherein the sheet arrangement comprises a multitude of adjacent unit cells, a unit cell representing an area which corresponds to a projection through the sheet arrangement with regard to the floor space of a single individual metalization element of the first metalized sheet.

8. The leaky-wave antenna as claimed in claim 7, wherein the plurality of further individual metalization elements of the second metalized sheet is rotated by an angle of 45° with regard to the individual metalization elements of the first metalized sheet.

9. The leaky-wave antenna as claimed in claim 7, wherein the area centers of the individual metalization elements of the first metalized sheet are offset from the further individual metalization elements of the second metalized sheet.

10. The leaky-wave antenna as claimed in claim 1, wherein the sheet arrangement comprises a non-directional dispersion characteristic at the working frequency $f_0$.

11. The leaky-wave antenna as claimed in claim 1, wherein the sheet arrangement is configured to provide a radially symmetrical propagation of leaky waves at the operating frequency of the leaky-wave antenna upon excitation by the excitation structure.

12. The leaky-wave antenna as claimed in claim 1, wherein the excitation structure is configured to excite a linearly, cross-, and/or circularly polarized wave in the sheet arrangement.

13. The leaky-wave antenna as claimed in claim 12, wherein the excitation structure is centrally arranged on the sheet arrangement as a cross-dipole arrangement.

* * * * *